US007834777B2

(12) United States Patent
Gold

(10) Patent No.: US 7,834,777 B2
(45) Date of Patent: Nov. 16, 2010

(54) DOWNHOLE POWER SOURCE

(75) Inventor: Randy Gold, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 1019 days.

(21) Appl. No.: 11/607,678

(22) Filed: Dec. 1, 2006

(65) Prior Publication Data

US 2008/0128123 A1 Jun. 5, 2008

(51) Int. Cl.
*G01V 3/00* (2006.01)

(52) U.S. Cl. ..... 340/855.8; 340/854.4; 367/83; 166/66

(58) Field of Classification Search ..... 340/855.8; 367/83; 166/66
See application file for complete search history.

(56) References Cited

U.S. PATENT DOCUMENTS

| | | | | |
|---|---|---|---|---|
| 4,428,440 | A | 1/1984 | McPhee | |
| 6,095,258 | A | 8/2000 | Reese et al. | |
| 6,392,313 | B1 | 5/2002 | Epstein et al. | |
| 6,554,074 | B2 | 4/2003 | Longbottom | |
| 6,672,409 | B1 | 1/2004 | Dock et al. | |
| 6,745,844 | B2 | 6/2004 | Henderson | |
| 2004/0079301 | A1 | 4/2004 | Perlo et al. | |
| 2005/0024231 | A1 * | 2/2005 | Fincher et al. | 340/854.4 |
| 2005/0207279 | A1 * | 9/2005 | Chemali et al. | 367/83 |
| 2006/0113803 | A1 * | 6/2006 | Hall et al. | 290/54 |
| 2007/0104996 | A1 * | 5/2007 | Eickhoff et al. | 429/34 |
| 2007/0124989 | A1 * | 6/2007 | Eickhoff et al. | 44/301 |
| 2007/0184312 | A1 * | 8/2007 | Eickhoff | 429/22 |
| 2009/0134623 | A1 * | 5/2009 | Krouse | 290/43 |

* cited by examiner

*Primary Examiner*—Timothy Edwards, Jr.
(74) *Attorney, Agent, or Firm*—Bracewell & Giuliani LLP

(57) ABSTRACT

A power source for use in a downhole environment. The power source can include a microgenerator, where the microgenerator is comprised of a motive source, a rotor, a stator, and an electrical load. The motive source can be compressed gas, liquid, two-phase fluid, or combustion gases. The rotor may comprise a magnet and the stator may comprise a coil, such that rotating the rotor coaxially proximate to the stator produces electrical current. The electrical load includes any device used in downhole exploration and production that requires electrical energy.

24 Claims, 2 Drawing Sheets

DOWNHOLE POWER SOURCE

BACKGROUND OF THE INVENTION

1. Field of the Invention

The invention relates generally to the field of hydrocarbon production. More specifically, the present invention relates to a power source for use within a wellbore.

2. Description of Related Art

Recent advancements in the field of oil and gas exploration and production have produced devices requiring a constant source of power. Typically, these devices are powered through a dedicated power supply that is in electrical communication with these devices. One example of a device requiring downhole power includes acoustic signal producers that are disposed downhole for identification of casing perimeters such as defects and/or location of casing collars. Other examples of energy consuming devices downhole include sensors disposed within a casing for monitoring fluid flow parameters, such as pressure, temperature, and flow rate. Additional sensors include an optical sensor, an electromagnetic energy sensor or an acoustic sensor. Optionally, these devices might also be utilized for measuring fluid viscosity and density as well. With the advent of reservoir management techniques, sophisticated monitoring and valving has been integrated in downhole casing. Thus certain portions of a subterranean formation can be produced while at the same time sealing off other portions of the formation by virtue of controlling these valves. The flow monitors and flow control systems are other examples of devices that require an external power source while disposed downhole.

Telemetry systems, such as acoustic and electromagnetic, are additional downhole devices that may be powered with a downhole power supply. These systems include means for generating a seismic signal downhole that travels up the borehole where the resulting signal is received and collected for additional analysis. Additional acoustic devices include transmitters and receivers, such as piezoelectric, electromagnetic acoustic transducers, a pulse laser, signal transmitter, signal receiver and flexural resonators.

The field of downhole ballistics also employs utilization of downhole electrical current. One example of a downhole ballistics device is a perforating gun having shaped charges stored therein. The shaped charges of the perforating guns are typically initiated electrically via an initiation circuit disposed within the perforating gun. Moreover these perforating guns can be oriented within the wellbore with an orientation device, wherein the orientation device can be electrically or mechanically actuated. It should be pointed out that the list of devices using electrical current provided herein is merely a sampling and is not meant to be an exhaustive list.

Power supplies for downhole use currently includes batteries, voltaic cells, wireline transmission, and downhole motors. Examples of downhole motors can be found in U.S. Pat. No. 6,554,074 issued to Longbottom, U.S. Pat. No. 6,745,844 issued to Henderson, and U.S. Pat. No. 6,672,409 issued to Dock, et al. However each of these devices suffers from one of more of the following drawbacks. For example, for use within a wellbore any device must be able to withstand the harsh environment experienced downhole. Often the temperatures downhole can exceed over 100° C. Thus a limited number of batteries are applicable for such use, for example lithium has been found to be a useful battery component. However lithium can be toxic and lithium batteries also are susceptible to exploding. Furthermore, batteries made from lithium can be quite expensive and they are not rechargeable.

With regard to wireline supplied power downhole, additional limitations exist by using this as an electrical source. For example, the diameter of the wireline is limited due to weight constraints, which limits the amount of electrical current that can flow through the wireline. Additionally, the wireline is also used for transmitting data to and from the downhole tool to which the wireline is attached. This further limits the amount of current that can reasonably be transmitted along the wireline. An additional limitation of wireline is that it is used in conjunction with some sort of wireline tool, such as an acoustic or perforating device. Thus with regard to devices involved in reservoir management, such the sensors and valving described above, a wireline source of electrical current would be inappropriate.

With regard to downhole motors, these typically rely upon a flow of either drilling mud or production fluid past a turbine in order to generate either electrical or mechanical power. These devices tend to be somewhat bulky thereby consuming a large amount of space when disposed within the wellbore. Moreover, since these devices require the flow of fluid, they are not operative without a substantial amount of fluid flow within the wellbore. Since there are periods of time with limited or no flow through the wellbore, these devices are limited in the time that they may be able to operate. Additionally, since these require the flow of fluid they necessarily produce a pressure drop of wellbore fluid flow, which has other undesirable affects during exploration and/or production. Therefore there exists a need for a device that can supply downhole power at the harsh downhole environment without hindering otherwise normal exploration and production activities. Moreover, there exists a need for the use of a downhole power source that can be utilized without the requirements of large weight and/or volume.

BRIEF SUMMARY OF THE INVENTION

The device of the present disclosure includes a downhole power source comprising, a pressurized motive source in communication with a turbine, a magnetized rotor operatively coupled to the turbine, a winding in electromagnetic communication with the rotor, and a load electrically connected to the winding. The pressurized source contains fluid such as gas, liquid, or a two phase mixture of gas and liquid as well as a combustion product. An additional power source may be included with the device, such as a battery, a voltaic cell, or a downhole motor.

The downhole power source may optionally comprise a microgenerator, a pressurized fluid source in communication with the microgenerator, and an electrical load in electrical communication with the microgenerator. 13. The microgenerator may comprise a rotational activation system, a magnetic member coupled to the rotational activation system, and an alternator in electromagnetic communication with the magnetic member and in electrical contact with a resistive load. The rotational activation system may comprise a turbine formed to receive pressurized fluid from a pressurized fluid source. The pressurized fluid source may provide a pressurized fluid such as a gas, liquid, a gas and liquid mixture, and a combustion product.

DETAILED DESCRIPTION OF THE INVENTION

Figure 1:
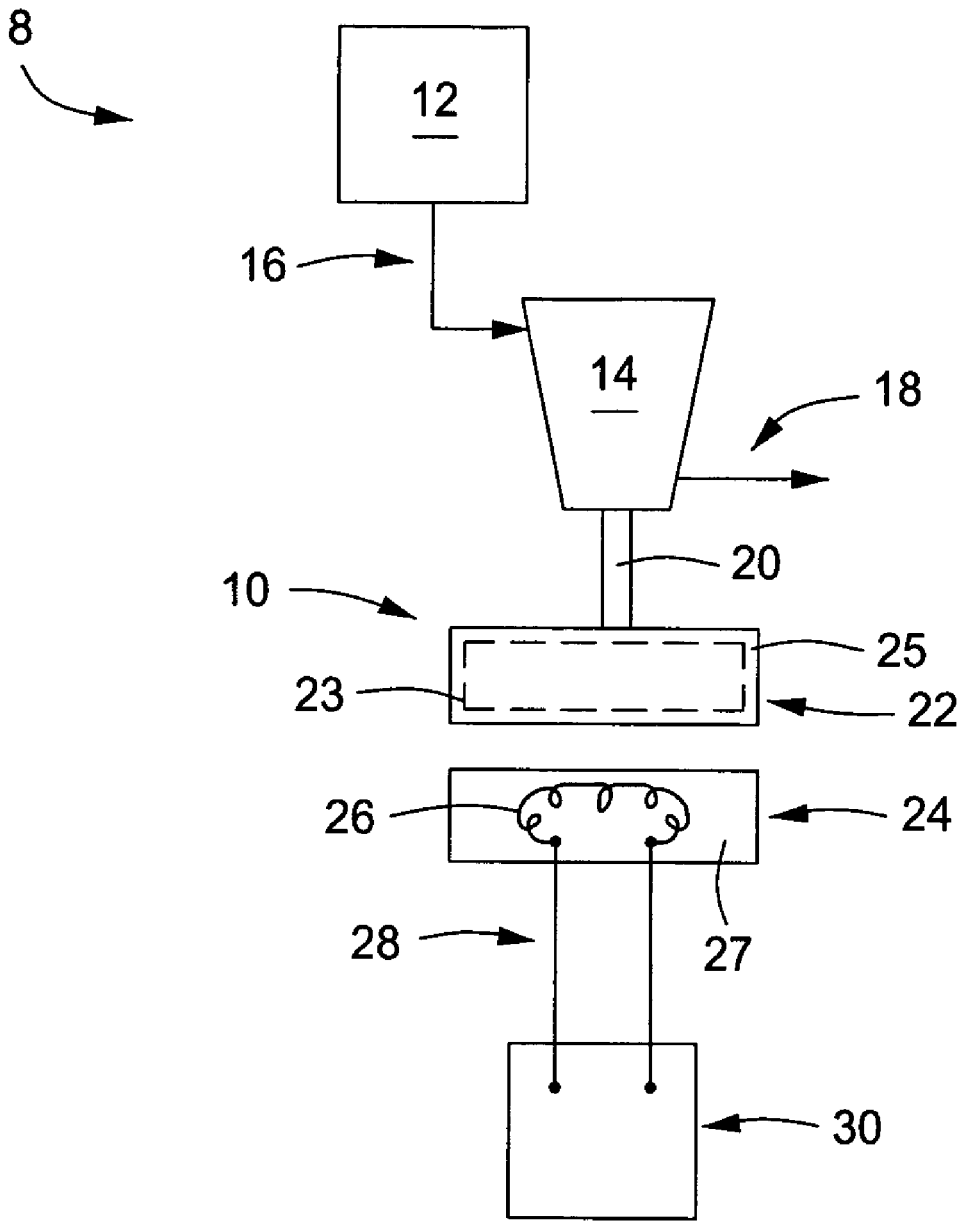
FIG. 1 illustrates in schematical view a power source in combination with an electrical load.

The device and apparatus that is the subject of the present disclosure is a system for the generation of power for use downhole. One embodiment of a downhole power source 8 in accordance with the present disclosure is shown in schematically view in FIG. 1. The downhole power source 8 is comprised of a microgenerator 10 in communication with a motive gas source 12. The microgenerator 10 further comprises a rotor 22 that is in electromagnetic communication with a stator 24, wherein the electromagnetic communication is capable of producing an electrical current for powering a load 30.

As shown in this embodiment the microgenerator 10 comprises a rotational activation system, such as a turbine 14 mechanically connected to the rotor 22 via a shaft 20. Although the embodiment of FIG. 1 is shown in a side schematical view, it should be pointed out that the rotor 22 preferably has a disc like configuration wherein the diameter of the disc exceeds its thickness. Since the rotor 22 is mechanically affixed to the output of the turbine 14 via the output shaft 20, rotation of the turbine 14 correspondingly causes rotation of the rotor 22.

In the embodiment of FIG. 1, the turbine 14 is powered by the motive source 12 in which pressurized gas is stored. Pressurized gas is delivered to the turbine 14 from the motive source 12 via the inlet line 16. An exit line 18 is provided on the outlet side of the turbine 14. The pressurized fluid can be either pressurized gas, high-pressure liquid where the high-pressure liquid can be delivered through the turbine either in liquid form, or can be vaporized in the inlet line 16 for powering the turbine 14. Optionally, the fluids stored within the motive fluid source 12 can be a mixture of gas and liquid. Moreover, the motive fluid source 12 can comprise a combustion chamber wherein the exhaust gases from the combustion is fed to the turbine 14 via the inlet line 16 for rotation of the turbine. The turbine energy source includes pressurized gas source piped from surface or another remote location in the wellbore, or generated in-situ via chemical reaction, etc.

One example of a microgenerator powered by combustive gases can be found in U.S. Pat. No. 6,392,313 issued to Epstein, et al., the entire disclose of which is incorporated for reference herein. Other microgenerators suitable for use with the present invention can be found in Patent Application Publication No. US 2004/0079301 in the name of Perlo, et al. published Apr. 29, 2004.

In the embodiment of FIG. 1, the rotor 22 includes a magnet 23 housed within an outer casing 25. Alternatively however, the entire rotor 22 may be comprised of a magnetic material. As shown, the magnet 23 is a permanent magnet, however the magnet may also be an electrostatic magnet or an electrical magnet. Additionally, the rotor 22 may be comprised entirely of a magnet without the outer casing 25. As shown, the stator 24 comprises at least one coil 26 disposed within a housing 27. The stator should be sufficiently proximate to the rotor 22 such that it lies within the magnetic field produced by the magnet 23. Additionally, the stator 24 should be substantially coaxial with the rotor 22. Although the stator 24 of FIG. 1 includes a single coil 26, the stator 24 can include additional coils, wherein each coil will operate at a different phase from the other coils. It is well within the scope of those skilled in the art to properly position the coils 26 of the stator within the magnetic field of the magnet 23 and in the proper orientation for the production of electrical power.

Leads 28 are connected to the ends of the coils 26 thereby providing electrical communication from the coil 26 to the electrical load 30. In operation, as the turbine 14 is powered by the motive fluid source 12 its resulting rotation thereby causes rotation of the rotor 22. Due to the presence of the magnet 23 within the rotor 22, an electrical current will be induced within the coil 26. Optionally, the combination of the coil 26 disposed within the stator and in proximity of the magnet 23, the resulting combination can act as an alternator for producing electrical current. The induced electrical current can then be delivered to the electrical load 30 via the leads 28. The electrical load 30 considered to be within the scope of disclosure herein, can include any device used in a downhole environment that consumes electrical energy. Additionally, the coil 26 and the leads 28 should be comprised of an electrically conducting material, and can be comprised of the same or different materials. Optionally, the load 30 may comprise an electrical energy storage device such as a capacitor or battery.

Figure 2:
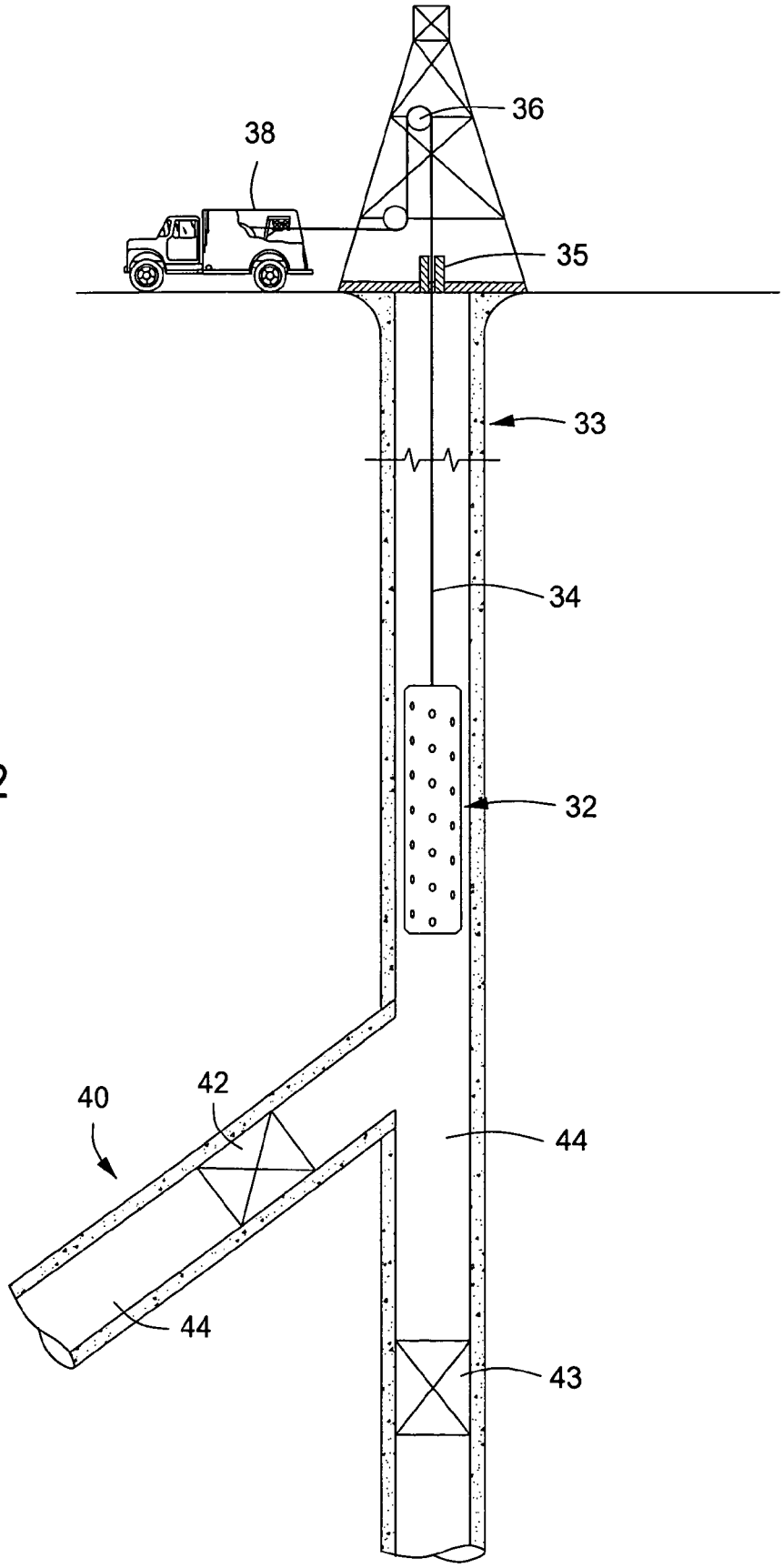
FIG. 2 depicts in partial cross sectional area a downhole tool disposed on a wellbore.

FIG. 2 illustrates some possible applications of the downhole power source 8 as described herein. In this figure, the partial side view of a downhole tool 32 disposed within a cased wellbore 33 on wireline 34 is illustrated. A downhole tool 32 is suspended on the wireline 34 via pulleys 36 and inserted into the wellbore 33 through a packoff head 35. A surface truck 38 provides surface connectivity to a downhole tool 32 via the wireline 34. The downhole tool 32 may be comprised of a perforating gun having shaped charges within an associated initiator wherein the initiator is powered by the downhole power source 8. Optionally, the downhole tool 32 may also be an acoustic device having a series of transducers for emitting and receiving acoustic signals within the wellbore 33. Similarly, these transducers could be powered by the downhole power source 8. A lateral wellbore 40 is shown extending away from the primary wellbore 33. As previously discussed, advances in reservoir management have included the use of systems for isolating not only zones with a particular wellbore but also different legs of a wellbore circuit. For example, the lateral wellbore 40 can be isolated from the primary wellbore 33 by inclusion of a valve 42 proximate to the point where the lateral wellbore extends away from the primary wellbore 33. Thus reservoir management could involve selective operation of this valve 42 to allow for lateral wellbore production when desired or optimal. The valve 43 may also be disposed within the primary wellbore such that both the primary wellbore 33 and the lateral wellbore 40 can be produced at the same time, or at alternate times. Operation of these valves (42, 43) can be powered by use of the downhole power source 8. The downhole power source 8 can be integrated within each of these valves, or can be coupled with a valve actuator that is mechanically connected to these valves (42, 43).

In the embodiment of use of FIG. 2, wellbore sensors 44 are shown within both the primary wellbore 33 and the lateral wellbore 40. Selective positioning of these sensors can provide for readings of pressure, temperature, flow, viscosity, or fluid density of the fluids either flowing through or resident within each of these respective wellbores. The downhole power source 8 can be coupled with these sensors 44 for powering the sensors during operation. One of the many advantages of the apparatus as disclosed herein, is that the downhole power source 8 can be disposed within the wellbore for long periods of time thereby operating these sensors 44 without the need for replacement of batteries or other means of supplying power to these sensors. Thus in the example provided by FIG. 2, the electrical load 30 can either be perforating initiators, transducers, valve actuators, or sensors. Additional examples of electrical loads can include sliding sleeves, packers, telemetry transducers (both acoustic and electromagnetic), orientation devices, nuclear magnetic resonance devices, a pump, a processor, a controller, a clamping arm, an anchoring system and combinations thereof.

With regard to the rotor 22, because of the high rate of rotation expected (100,000 rpm to excess of 500,000 rpm) many magnetic materials are unable to withstand this type of centrifugal load. Therefore the casing 25 should have a sufficiently high tensile strength to maintain the structural integrity and original shape of the magnet 23. One example of suitable material for such a housing would be titanium, or nickel alloy material such as Inconel®. Moreover, due to the high temperatures experienced downhole the magnetic material should also be able to withstand these high temperatures. Thus a suitable material includes samarium cobalt.

Optionally it should be pointed out that the downhole power source 8 disclosed herein can be coupled with additional power sources. Additional power sources can include wireline, external batteries, voltaic cell, or downhole motor, or combinations thereof.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A downhole power source comprising:

a pressurized motive source having pressurized gas stored therein and in communication with a turbine;

a magnetized rotor operatively coupled to the turbine;

a winding in electromagnetic communication with the rotor; and a load electrically connected to the winding.

2. The downhole power source of claim 1 wherein said pressurized source contains fluid selected from the list consisting of gas, liquid, or a two phase mixture of gas and liquid.

3. The downhole power source of claim 1, wherein said pressurized fluid source comprises a combustion product.

4. The downhole power source of claim 1 further comprising an additional power source.

5. The downhole power source of claim 4, wherein said additional power source is selected from the list consisting of electrical energy supplied via wireline, a battery, a voltaic cell, and a downhole motor.

6. The downhole power source of claim 1, wherein the electrical load is selected from the list consisting of a sensor, a downhole actuator, a sliding sleeve, a packer, a telemetry device, a pump, a transducer, a downhole detonation system, a processor, and a controller.

7. The downhole power source of claim 6, wherein the sensor is selected from the list consisting of a pressure sensor, a temperature sensor, a flow sensor, an optical sensor, an electromagnetic energy sensor or an acoustic sensor.

8. The downhole power source of claim 6, wherein the downhole actuator is selected from the list consisting of a clamping arm and an anchor.

9. The downhole power source of claim 6, wherein the transducer is selected from the list consisting of a piezoelectric device, an electromagnetic acoustic transmitter, a pulsed laser, a flexural resonator, a signal transmitter, and a signal receiver.

10. The downhole power source of claim 6, wherein the load consists of an electrical energy storage device.

11. The downhole power source of claim 10, wherein the electrical energy storage device is selected from the list consisting of a capacitor and a battery.

12. A downhole power source comprising:

a microgenerator;

a pressurized fluid source insertable downhole with the micro generator and in communication with the microgenerator; and an electrical load in electrical communication with the microgenerator.

13. The downhole power source of claim 12, wherein the microgenerator comprises a rotational activation system, a magnetic member coupled to the rotational activation system, and an alternator in electromagnetic communication with the magnetic member and in electrical contact with a resistive load.

14. The downhole power source of claim 13, wherein the rotational activation system comprises a turbine formed to receive pressurized fluid from a pressurized fluid source.

15. The downhole power source of claim 14, wherein the pressurized fluid source provides a pressurized fluid selected from the list consisting of gas, liquid, a gas and liquid mixture, and a combustion product.

16. The downhole power source of claim 14 wherein the magnetic member comprises an electromagnetic source formed to receive rotational motion upon application of the pressurized fluid to the turbine.

17. The downhole power source of claim 12, wherein the alternator is comprised of an electrically conducting coil having leads connected to the resistive load.

18. The downhole power source of claim 17 further comprising an additional electrically conducting coil having leads connected to the resistive load, wherein each coil conducts electrical energy at differing phases.

19. The downhole power source of claim 12 further comprising an additional power source.

20. The downhole power source of claim 19, wherein said additional power source is selected from the list consisting of electrical energy supplied via wireline, a battery, a voltaic cell, and a downhole motor.

21. The downhole power source of claim 12, wherein the resistive load is selected from the list consisting of a sensor, a downhole actuator, a sliding sleeve, a packer, a telemetry device, a pump, a transducer, a downhole detonation system, a processor, and a controller.

22. The downhole power source of claim 21, wherein the sensor is selected from the list consisting of a pressure sensor, a temperature sensor, and a flow sensor.

23. The downhole power source of claim 21, wherein the downhole actuator is selected from the list consisting of a clamping arm and an anchor.

24. The downhole power source of claim 21, wherein the transducer is selected from the list consisting of a piezoelectric device, an electromagnetic acoustic transmitter, a pulsed laser, a flexural resonator, a signal transmitter, and a signal receiver.

* * * * *